US010384359B2

(12) United States Patent
Houbolt et al.

(10) Patent No.: US 10,384,359 B2
(45) Date of Patent: Aug. 20, 2019

(54) SHAVING HEAD WITH SKIN STRETCHING MEMBER

(75) Inventors: Erik Houbolt, Drachten (NL); Marco Christiaan Hamburg, Drachten (NL); Everhardus Johannes Hoexum, Drachten (NL); Hendrik Klaas Paauw, Hoogeveen (NL); Mark Wesseling, Hoogeveen (NL); Hette Akkerman, Drachten (NL)

(73) Assignee: KONINKLIJKE PHILIP N.V., Eindhoven (NL)

( * ) Notice: Subject to any disclaimer, the term of this patent is extended or adjusted under 35 U.S.C. 154(b) by 154 days.

(21) Appl. No.: 10/581,218

(22) PCT Filed: Dec. 8, 2004

(86) PCT No.: PCT/IB2004/052707

§ 371 (c)(1),
(2), (4) Date: Jun. 1, 2006

(87) PCT Pub. No.: WO2005/056251

PCT Pub. Date: Jun. 23, 2005

(65) Prior Publication Data

US 2007/0089297 A1 Apr. 26, 2007

(30) Foreign Application Priority Data

Dec. 10, 2003 (EP) ..... 03104612

(51) Int. Cl.
*B26B 21/34* (2006.01)
*B26B 21/22* (2006.01)

(52) U.S. Cl.
CPC ..... *B26B 21/34* (2013.01); *B26B 21/22* (2013.01); *B26B 21/225* (2013.01)

(58) Field of Classification Search
CPC ..... B26B 19/40; B26B 19/42; B26B 21/40; B26B 21/4012; B26B 21/4018;
(Continued)

(56) References Cited

U.S. PATENT DOCUMENTS 2,101,737 A * 12/1937 Gesler ..... 30/34.2
2,766,521 A * 10/1956 Benvenuti ..... 30/34.2
(Continued)

FOREIGN PATENT DOCUMENTS

DE 1003087 B 2/1957
DE 195 14 228 10/1996
(Continued)

*Primary Examiner* — Jason Daniel Prone

(57) ABSTRACT

A shaving head is provided that includes one or more cutting blades and actively driveable skin stretching device arranged behind said cutting blade. The actively driveable skin stretching device operates to reduce the possibility of causing nicks and cuts or skin irritation during a shaving operation. The shaving head provides a pivot axis between the shaving head and a handle that is either attached or attachable to the shaving head. The pivot axis is arranged to be essentially parallel to the cutting blade. By providing the pivot axis, the force ratio between a force applied to the actively driveable skin stretching device and forces applied to other parts of the shaving head may be kept constant for different angles of the handle. This improves the functioning of the actively driveable skin stretching device.

10 Claims, 2 Drawing Sheets

(58) Field of Classification Search
CPC ... B26B 21/4025; B26B 21/443; B26B 21/52; B26B 21/521
USPC ..... 30/34.2, 41, 45, 50, 51, 58, 59, 60, 63, 30/65
See application file for complete search history.

(56) References Cited

U.S. PATENT DOCUMENTS

| | | | | | |
|---|---|---|---|---|---|
| 2,837,820 | A | * | 6/1958 | Ostrowski | 30/51 |
| 3,138,865 | A | * | 6/1964 | Meyer | 30/34.2 |
| 3,183,591 | A | | 5/1965 | Dumont | |
| 4,378,633 | A | * | 4/1983 | Jacobson | 30/50 |
| 4,502,217 | A | * | 3/1985 | Schachter | 30/82 |
| 5,038,472 | A | * | 8/1991 | Iderosa | 30/51 |
| 5,251,376 | A | * | 10/1993 | Althaus et al. | 30/50 |
| 5,299,354 | A | * | 4/1994 | Metcalf et al. | 30/45 |
| 5,661,907 | A | * | 9/1997 | Apprille, Jr. | 30/50 |
| 5,678,311 | A | * | 10/1997 | Avidor | 30/34.2 |
| 5,933,960 | A | | 8/1999 | Avidor et al. | |
| 6,009,623 | A | * | 1/2000 | Orloff | 30/41.7 |
| 6,070,327 | A | * | 6/2000 | Taso | 30/34.2 |
| 6,161,288 | A | * | 12/2000 | Andrews | 30/50 |
| 6,434,828 | B1 | * | 8/2002 | Andrews | 30/50 |
| 6,442,840 | B2 | * | 9/2002 | Zucker | 30/34.2 |
| 6,481,104 | B1 | * | 11/2002 | Parker et al. | 30/45 |
| 7,251,894 | B2 | * | 8/2007 | Zuidervaart et al. | 30/34.2 |
| 7,797,834 | B2 | * | 9/2010 | Steunenberg et al. | 30/50 |
| 2001/0015017 | A1 | | 8/2001 | Brzesowsky | |
| 2005/0108879 | A1 | * | 5/2005 | Coffin et al. | 30/41 |
| 2007/0151106 | A1 | * | 7/2007 | Steunenberg et al. | 30/50 |

FOREIGN PATENT DOCUMENTS

| | | | | |
|---|---|---|---|---|
| EP | 0320626 | A | | 6/1989 |
| JP | 01076894 | A | | 3/1989 |
| JP | 06142351 | A | * | 5/1994 |
| WO | 0074903 | A1 | | 12/2000 |
| WO | 200107212 | A2 | | 2/2001 |
| WO | WO 2005053917 | A1 | * | 6/2005 |
| WO | WO 2005056251 | A1 | * | 6/2005 |

* cited by examiner

SHAVING HEAD WITH SKIN STRETCHING MEMBER

The present invention relates to a shaving head comprising at least one cutting blade and actively driveable skin stretching means arranged behind said cutting blade relative to a cutting direction of said cutting blade.

A shaving head of the type mentioned above is well known in the art. Such a shaving head is also known as a safety razor. A problem that still occurs in connection with the known safety razors is the possibility that nicks and cuts or irritations of the skin to be shaved are created during the shaving operation.

This problem can at least be reduced by providing skin stretching means, for example in the form of a driven roller, behind the cutting blade. Such a solution is known from DE19514228A1. This documents discloses a razor having a shaving head of the above mentioned type, wherein a first roller is provided in front of the cutting blades and a second roller is provided behind the cutting blades. The first roller is driven by moving the shaving head over the skin. Furthermore, the first roller and the second roller are coupled by a gear wheel such that the second roller is driven to rotate faster than the first roller to provide the skin stretching effect. However, with the solution known from DE19514228A1 the desired skin stretching effect is achieved, only if the person using the razor properly inclines the handle, and thereby the shaving head, such that both the first and the second roller properly contact the skin to be shaved. This is not possible in all conditions of use.

It is an object of the invention to improve a shaving head of the above mentioned type such that the skin stretching effect is obtained under all conditions of use.

In order to achieve this object, a shaving head in accordance with the invention is characterized in that it comprises means for providing a pivot axis between the shaving head and a handle attached or attachable to said shaving head, said pivot axis being arranged at least essentially parallel to said cutting blade. Contrary to known razors having pivotable shaving heads to optimize the shaving angle, the solution in accordance with the present invention provides a pivot axis which ensures that the actively driveable skin stretching means properly contact the skin to be shaved, under all conditions of use and at different handle angles. Furthermore, by the pivot axis there is provided a constant force ratio between a pressure force applied to the skin stretching means and pressure forces applied to other parts of the shaving head, especially a pressure force applied to guard means discussed in detail below. This constant force ratio results in a more constant driving force of the skin stretching means on the shaving head, and thereby control of the razor during shaving is improved. Stretching the skin behind the cutting blade under all conditions of use stiffens the hair anchoring and raises the hairs. A stiffer hair anchoring and raised hairs enlarge the chance of cutting the hairs, reduce pulling on hairs and give a cleaner cut. Furthermore, stretching the skin reduces skin doming in front of the cutting blade and improves the force balance between the cutting blade and the skin. This leads to improved safety and comfort. The means for providing the pivot axis may be realized by any suitable solution known in the art, especially by a hinge, an integral hinge, a coupling mechanism also used to couple the shaving head to the handle, or snap-in hooks.

A particular embodiment of a shaving head in accordance with the invention is characterized in that between said shaving head and said handle, when attached to the shaving head, there is provided at least one spring element. The spring element preferably is arranged to limit the pressure the user exerts on the skin to be shaved. The spring element may form a part of the handle and/or it may connect a section of the handle to the shaving head.

A particular embodiment of a shaving head in accordance with the invention further comprises guard means arranged in front of said cutting blade relative to said cutting direction of said cutting blade. The guard means may for example be realized by a further roller or by a gliding element, for example a gliding element having a rectangular cross section and comprising grooves in the surface intended for contact with the skin.

In a preferred embodiment of a shaving head in accordance with the invention said guard means are adapted to perform a hair erecting function. If the hair is erected before it is cut by the cutting blade, a closer cut is obtained.

Additionally or alternatively it may be advantageous if said guard means are adapted to perform a lubricating function.

Furthermore, it is possible that said guard means comprise at least one strip arranged parallel to said cutting blade.

In a preferred embodiment of a shaving head in accordance with the invention said pivot axis is arranged such that a force component applied perpendicularly to said cutting direction during a shaving operation is distributed at least essentially in equal parts to said actively driveable skin stretching means and said guard means. At least in some cases this may be effected by placing the pivot axis exactly in the middle between the actively driveable skin stretching means and the guard means. In general the optimal position of the pivot axis depends on the friction between skin and guard means, the friction between skin and actively driveable skin stretching means as well as the traction of the actively driveable skin stretching means. In many cases the optimal position of the pivot axis lies between the above mentioned middle position and the guard means.

A preferred embodiment of a shaving head in accordance with the invention is characterized in that said pivot axis is arranged closer to said guard means than to said skin stretching means. In any case the force ratio between the force applied to the skin stretching means and the force applied to the guard means is kept at least essentially constant under all conditions of use, especially for different handle angles.

A particular embodiment of a shaving head in accordance with the invention is characterized in that said means for providing a pivot axis parallel to said cutting blade comprise first coupling means for coupling said shaving head to said handle. Such first coupling means are especially advantageous if for replacing the cutting blade the whole shaving head is replaced.

In a preferred embodiment of a shaving head in accordance with the invention said actively driveable skin stretching means comprise at least one actively driveable roller. This roller may be intended for direct contact with the skin. In other embodiments there may be provided a closed loop system, for example a closed loop web, supported by the actively driveable roller and at least a further roller.

In a preferred embodiment of a shaving head in accordance with the invention the sense of rotation of said roller, when active during a shaving operation, corresponds to its reeling sense of rotation relative to said cutting direction, and the rotational speed of the actively driven roller is higher than the rotational speed that would result from the movement of the shaving head. By virtue thereof an optimal skin stretching effect is obtained.

In accordance with one aspect of the invention said actively driveable skin stretching means are driven via a movement of the shaving head over skin to be shaved. For example a further roller or a wheel may be driven by moving the razor and the further roller or the wheel may drive the skin stretching means with a suitable gear ratio. Solutions similar to the one shown in DE19514228A1 may also be used.

In accordance with another aspect of the invention said actively driveable skin stretching means are driveable by an electromotor.

In a preferred embodiment said electromotor is associated with said shaving head. This makes sense particularly in cases where the cutting blade may be renewed separately from the shaving head.

In another preferred embodiment said electromotor is associated with said handle. This is especially advantageous if the whole shaving head is replaced for renewing the cutting blade.

Especially if the electromotor is associated with said handle, the shaving head preferably further comprises second coupling means for coupling said skin stretching element to said electromotor. The second coupling means may for example take the form of two engaging gear wheels, one associated with the handle comprising the electromotor and the other associated with the shaving head.

The above and further aspects and advantages of the invention will be apparent from and elucidated with reference to the embodiments of the invention described hereinafter and shown in the drawings. In the drawings.

Figure 1:
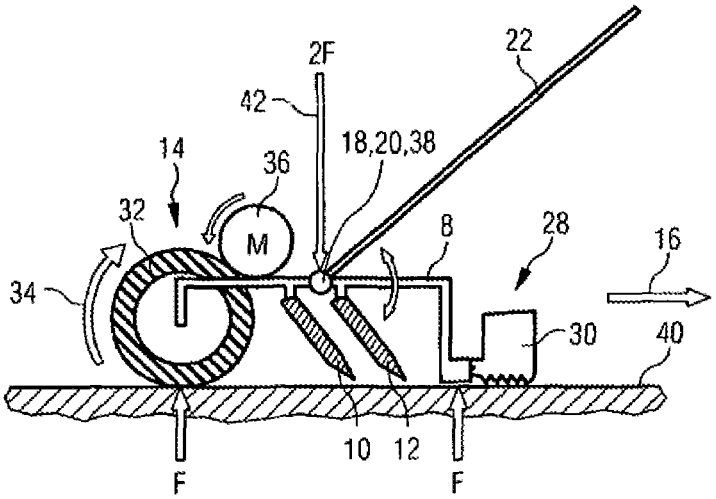
FIG. 1 is a simplified and schematic depiction of a first embodiment of a shaving head in accordance with the invention.

FIG. 1 is a simplified and schematic depiction of a first embodiment of the shaving head 8 in accordance with the invention. The shaving head 8 is coupled to a handle 22 by first coupling means 38. The first coupling means 38 may for example take the form of one or more snap-in hooks provided at the shaving head 8 for snapping in in one or more respective bridges provided at the handle 22. The shaving head 8 comprises two cutting blades 10,12 arranged such that a cutting direction 16 results. Relative to the cutting direction 16, behind the cutting blades 10, 12 there are provided actively driveable skin stretching means 14. The actively driveable skin stretching means 14 comprise a roller 32 which may be driven by an electromotor 36 associated with the shaving head 8. The roller 32 is driven such that the sense of rotation 34 corresponds with the reeling sense of rotation 34 relative to the cutting direction 16. Relative to the cutting direction 16, in front of the cutting blades 10,12 there are provided guard means 28. The guard means 28 comprise a strip 30 having a rectangular cross section in general and being provided with grooves in the surface intended for contact with skin 40 to be shaved.

During a shaving process, i.e. when a user moves the shaving head in the cutting direction 16, roller 32 is driven by the electromotor 36 to rotate in the sense of rotation 34 and with a rotational speed that is higher than the rotational speed that would result from the movement of the shaving head 8 over the skin 40. To ensure the optimal pressure force F for the roller 32 and the guard means 28, there are provided means 18 for providing a pivot axis 20 between the handle 22 and the shaving head 8. In the present embodiment the means 18 are made integral with the first coupling means 38 mentioned above. The location of the pivot axis 20 is essential for the present invention since this location defines how a force component 42 resulting from the pressure exerted on the handle by the user is distributed to the skin stretching means 14 and the guard means 28. In accordance with the present invention it is preferred that the force component 42 having the magnitude 2F is distributed equally to the skin stretching means 14 and the guard means 28. In the embodiment shown in FIG. 1 this is achieved by providing the pivot axis 20 exactly in the middle between the skin stretching means 14 and the guard means 28. However, in general the optimal position of the pivot axis depends on the friction between the skin 40 and guard means 28, the friction between the skin 40 and the roller 32 as well as the traction of the actively driveable skin stretching means 14. An area that is preferred for arranging the pivot axis 20 will be discussed with reference to FIG. 2.

Figure 2:
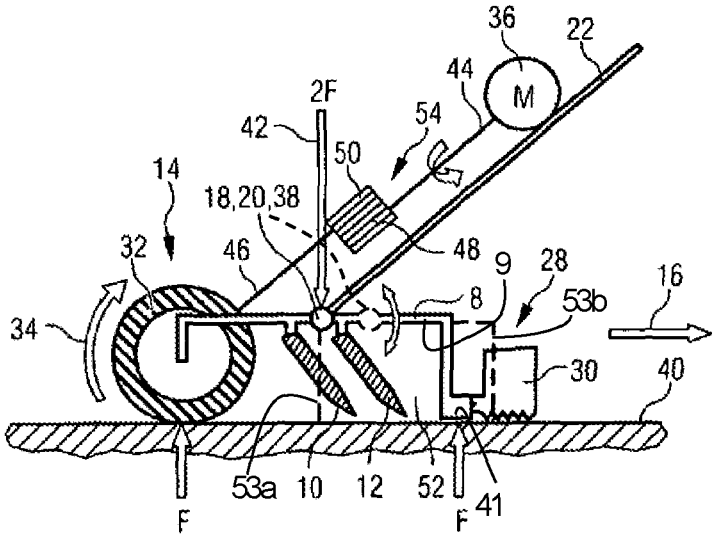
FIG. 2 is a simplified and schematic depiction of a second embodiment of a shaving head in accordance with the invention.

FIG. 2 is a simplified and schematic depiction of a second embodiment of the shaving head 8 in accordance with the invention. The embodiment shown in FIG. 2 differs from the embodiment of FIG. 1 in that electromotor 36 is associated with the handle 22. Without being limited thereto, this is especially advantageous in cases where the cutting blades 10, 12 are renewed by replacing the whole shaving head 8. The electromotor drives the roller 32 via two drive shafts 44, 46. These drive shafts 44, 46 are coupled by second coupling means 54 which in the present case include to engaging gear wheels 48.

FIG. 2 additionally indicates an area 52 (as defined by dotted lines 53*a* and 53*b*) which is preferred for arranging the pivot axis 20 on the shaving head. As may be seen from FIG. 2, this area 52 in the horizontal direction on the shaving head extends between the vertical dotted lines 53*a* and 53*b* at the middle between the actively driveable skin stretching means 14 and the guard means 28 and up to the guard means 28. In the vertical direction the area 52 extends on the shaving head between the upper surface 9 and the lower surface 41 of the shaving head 8. The area 52 is defined by the structure of the shaving head 8 that is within the vertical dotted lines 53*a* and 53*b*. Therefore, in many embodiments of the shaving head 8 in accordance with the invention there is a tendency to locate the pivot axis 20 on the shaving head closer to the guard means 28 than to the skin stretching means 14 such as shown by the dashed pivot axis 20 in the figure.

Figure 3:
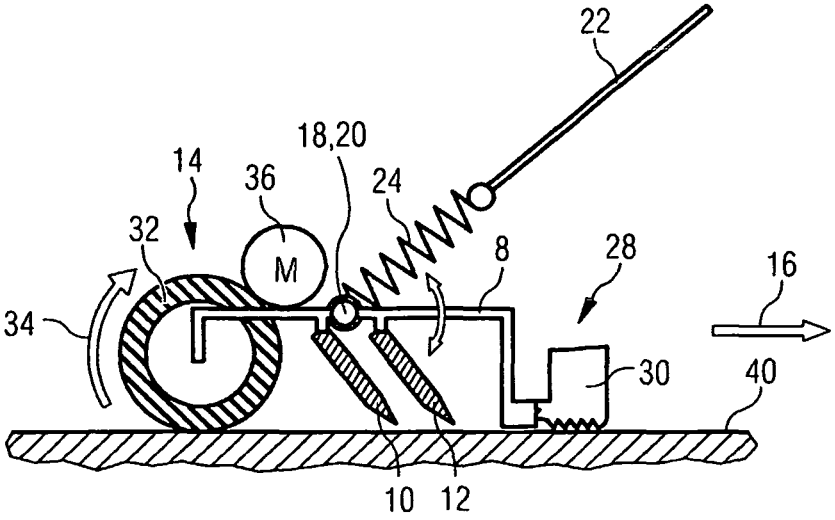
FIG. 3 is a simplified and schematic depiction of a third embodiment of a shaving head in accordance with the invention.

FIG. 3 is a simplified and schematic depiction of a third embodiment of the shaving head 8 in accordance with the invention. The embodiment shown in FIG. 3 differs from the embodiment of FIG. 1 in that the handle 22 comprises a flexible portion or spring element 24. The spring element 24 is provided to limit the pressure exerted by the user on the shaving head 8.

Figure 4:
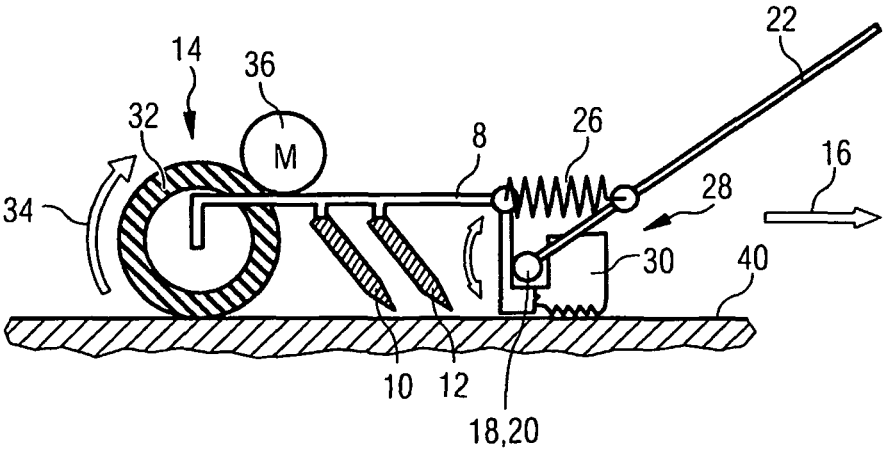
FIG. 4 is a simplified and schematic depiction of a fourth embodiment of a shaving head in accordance with the invention.

FIG. 4 is a simplified and schematic depiction of a fourth embodiment of the shaving head 8 in accordance with the invention. The embodiment shown in FIG. 4 differs from the embodiment of FIG. 1 in that the pivot axis 20 is located in front of the cutting blades 10, 12, and in that there is provided a spring element 26 between the handle 22 and the shaving head 8. The pivot axis 20 is arranged in front of the cutting blades 10, 12 to limit the pressure exerted by the user on the cutting blades 10, 12 and the roller 32.

It is to be noted that any reference signs used in the claims shall not be construed as limiting the scope of the invention.

The invention claimed is:

1. A shaving apparatus configured to move in contact with skin in response to a manual force applied by a user, the apparatus comprising:

a head having upper and lower surfaces;

one or more cutting blades attached to the upper surface of the head and configured to cut hairs in a cutting direction, the blades having corresponding cutting edges;

at least one roller attached to the head behind the one or more cutting blades relative to the cutting direction and configured to rotate and to stretch the skin in a direction opposite to the cutting direction;

a motor coupled to the at least one roller and configured to provide a motor force to actively rotate the at least one roller, wherein the motor is on the head;

a guard attached to the head in front of the one or more cutting blades relative to the cutting direction and configured to erect hair prior to cutting by the one or more cutting blades;

a coupling to the head at a location of the head positioned closer to the guard in the cutting direction than to the roller providing a pivot axis which is arranged essentially parallel to the one or more cutting blades; and a handle pivotably attached to the coupling and configured to enable the user to apply the manual force on the head at different angles of the handle with the location of the coupling to the head being closer to the guard in the cutting direction than to the roller so that the manual force during use is distributed in essentially equal parts between the at least one roller and the guard at any of the different angles of the handle.

2. The shaving apparatus according to claim 1, further comprising at least one spring element coupled to the head and the handle.

3. The shaving apparatus according to claim 1, wherein the guard is configured to perform lubricating.

4. The shaving apparatus according to claim 1, wherein the guard comprises at least one strip arranged parallel to the one or more cutting blades and is stationary in relation to the head.

5. The shaving apparatus according to claim 1, wherein the at least one roller is rotated in the cutting direction.

6. The shaving apparatus according to claim 1, further comprising a coupling configured to couple the at least one roller to the motor.

7. The shaving apparatus according to claim 1, wherein the attachment between the handle and the coupling is configured to allow the handle to be removed from the coupling.

8. A shaving apparatus configured to move in contact with skin in response to a manual force applied by a user, the apparatus comprising:

a head having upper and lower surfaces;

one or more cutting blades attached to the upper surface of the head and configured to cut hairs in a cutting direction, the blades having corresponding cutting edges:

a roller coupled to the head behind the one or more cutting blades relative to the cutting direction and configured to rotate thereby stretching the skin in a direction opposite to the cutting direction;

a guard coupled to the head and arranged in front of the one or more cutting blades relative to the cutting direction and configured to erect hair prior to cutting by the one or more cutting blades;

a motor coupled to one of the head and the roller and configured to provide a motor force to actively rotate the roller, wherein the motor is on the head in contact with the roller;

a coupling to the head at a location of the head positioned closer to the guard in the cutting direction than to the roller providing a pivot axis which is arranged essentially parallel to the one or more cutting blades; and a handle pivotably attached to the coupling and configured to enable the user to apply the manual force on the head at different angles of the handle with the location of the coupling to the head being closer to the guard in the cutting direction than to the roller so that the manual force during use is distributed in essentially equal parts between the roller and the guard at the different angles of the handle.

9. The shaving apparatus according to claim 8, wherein the attachment between the handle and the coupling is configured to allow the handle to be removed from the coupling.

10. The shaving apparatus according to claim 8, wherein the location and pivot axis are offset from the cutting edges.

* * * * *